US012317958B2

(12) United States Patent
Hermiller et al.

(10) Patent No.: US 12,317,958 B2
(45) Date of Patent: Jun. 3, 2025

(54) SHOE ACCESSORY AND RELATED SYSTEM, KIT, AND METHOD OF USE

(71) Applicants: Randy Hermiller, Ottawa, OH (US); Jessica Hermiller, Ottawa, OH (US)

(72) Inventors: Randy Hermiller, Ottawa, OH (US); Jessica Hermiller, Ottawa, OH (US)

( * ) Notice: Subject to any disclaimer, the term of this patent is extended or adjusted under 35 U.S.C. 154(b) by 8 days.

(21) Appl. No.: 18/449,857

(22) Filed: Aug. 15, 2023

(65) Prior Publication Data

US 2024/0049838 A1 Feb. 15, 2024

Related U.S. Application Data

(60) Provisional application No. 63/397,939, filed on Aug. 15, 2022.

(51) Int. Cl.
*A43B 23/24* (2006.01)

(52) U.S. Cl.
CPC ..... *A43B 23/24* (2013.01)

(58) Field of Classification Search
CPC ..... A43B 23/24; A43B 3/0078; A43B 3/30; A43C 19/00; A41D 27/08
USPC ..... 36/136; 2/245
See application file for complete search history.

(56) References Cited

U.S. PATENT DOCUMENTS

| | | | | |
|---|---|---|---|---|
| D554,847 | S | 11/2007 | Schmelzer et al. | |
| 8,069,538 | B2 | 12/2011 | Wilcox | |
| 8,122,519 | B2 | 2/2012 | Schmelzer et al. | |
| 10,966,488 | B2 | 4/2021 | Nguyen et al. | |
| 11,528,963 | B1 | 12/2022 | Separzadeh | |
| 11,808,445 | B1 * | 11/2023 | He | F21V 33/0008 |
| 2006/0048407 | A1 * | 3/2006 | Seamans | A43B 1/0081 36/3 R |
| 2007/0006502 | A1 | 1/2007 | Schmelzer et al. | |

(Continued)

FOREIGN PATENT DOCUMENTS

| | | | |
|---|---|---|---|
| CA | 2638356 | A1 | 1/2010 |
| KR | 200447942 | Y1 | 3/2010 |

OTHER PUBLICATIONS

AstroAdditive. Croc Pow Plow. Printables. URL="https://www.printables.com/model/163611-croc-pow-plow". Published at least as of Apr. 6, 2022. (Year: 2022).*

(Continued)

*Primary Examiner* — Jameson D Collier
(74) *Attorney, Agent, or Firm* — Jacob M. Ward; Ward Law Office LLC

(57) ABSTRACT

A shoe accessory is provided that can be removably attached to a polygonal hole of a shoe. The shoe accessory may include an outer flange having a first length, an inner flange having a second length greater than the first length, and a connecting portion spacing the outer flange from the inner flange. The connecting portion may have a polygonal cross-section. The inner flange may be configured to be inserted through the polygonal hole. The connecting portion may be configured to be disposed within the polygonal hole. The outer flange may be configured to be disposed adjacent an outer surface of the shoe. The outer flange may further include a face whereby a member may be disposed on the face with an adhesive to customize the shoe accessory with indicia, graphics, colors, and a combination thereof. A related shoe accessory kit and method of inserting the shoe accessory is provided.

17 Claims, 5 Drawing Sheets

(56) References Cited

U.S. PATENT DOCUMENTS

| | | | | |
|---|---|---|---|---|
| 2007/0130797 | A1* | 6/2007 | Seamans | B29D 35/0018 36/50.1 |
| 2008/0127525 | A1 | 6/2008 | Blunden et al. | |
| 2008/0263839 | A1 | 10/2008 | Stillwell | |
| 2009/0183344 | A1 | 7/2009 | Polsky | |
| 2013/0019381 | A1 | 1/2013 | Lovell | |
| 2013/0067641 | A1 | 3/2013 | Allen et al. | |
| 2015/0282575 | A1* | 10/2015 | Smith | A44C 17/0208 63/3 |
| 2019/0281928 | A1* | 9/2019 | Nguyen | A43B 3/30 |

OTHER PUBLICATIONS

Shutterz, "Shutterz 14 Pack Colored Shoe Charms, Compatible with Classic Crocs, Crush Crocs and All Terrain Crocs, Functional Charms for Girls, Boys, Kids, Teens, Men, Women" webpage, Amazon.com, ASIN : B0BL8YZYJ2, Nov. 2, 2022, US, https://www.amazon.com/SHUTTERZ-Colored-Compatible-Classic-Terrain/dp/B0BV93B42Z?th=.

Written Opinion of the International Searching Authority dated Nov. 16, 2023.

Okdeals, "1Pairs New Hole Shoe Accessories DIY Charm Buckle Snow Plow Croc Charm Attachment Shoe Charms Shoe Decoration", webpage, aliexpress.us, China, https://www.aliexpress.us/item/3256805162196486.html?pdp_npi=2%40dis%21USD%21%246.40%21%243.20%21%21%21%21%21%402103010b16836400308456043e89b4%2112000032707587894%21btf&_t=pvid%3Acc6f2007-022c-4441-b78b-e68400b61d88&afTraceInfo=1005005348511238_pc_pcBridgePPC_xxxxxx_1683640031&spm=a2g0o.ppclist.

Teyouyi, "Teyouyi Snow Plow for Crocs Charm Accessories for Crocs, Croc Charms Shoe Charms for Crocs Not Included Crocs Shoes A Pair", webpage, amazon.com, ASIN : B0BXBY5RXD, Mar. 3, 2023, https://www.amazon.com/TEYOUYI-Crocs-Accessories-Charms-Included/dp/B0BR4RS3S3/ref=asc_df_B0BR4RS3S3/?tag=hyprod-20&linkCode=df0&hvadid=642201867791&hvpos=&hvnetw=g&hvrand=16368037435945722561&hvpone=&hvptwo=&hvqmt=&hvdev=c&hvdvcmdl=&hvlocint=&hvlocphy=9016981&hvtargid=pla-1944383925499&gclid=CjwK.

* cited by examiner

SHOE ACCESSORY AND RELATED SYSTEM, KIT, AND METHOD OF USE

CROSS-REFERENCE TO RELATED APPLICATIONS

This application claims the benefit of U.S. Provisional Application No. 63/397,939, filed on Aug. 15, 2022. The entire disclosure of the above application is incorporated herein by reference.

FIELD

The present technology relates to a shoe accessory, particularly shoe accessories for insertion into trapezoidal holes provided in foam shoes.

INTRODUCTION

This section provides background information related to the present disclosure which is not necessarily prior art.

Consumers have attached ornaments to their footwear for centuries. Various types of foam shoes are provided with several holes in the top surface of the shoe. The holes may also be provided around the side surfaces in various dimensions. An example of a popular foam shoe is the CROCS™ clog which can allow a shoe accessory to be placed in the holes on the top surface of the shoe. The classic CROCS™ clog includes circular-shaped holes in the top surface of the shoe and trapezoidal holes circumscribing the side surface of the shoe. The holes can have accessories such as embellishments and charms placed therein to decorate the foam shoes.

The accessories are generally designed to be placed through the holes on the top surface of the foam shoes. However, the holes on the side surfaces are left undisturbed. Undesirably, the holes on the side surfaces of the shoe allow dirt and other debris to enter the hole as the holes are in direct contact with the path in which the consumer walks. An accumulation of dirt and debris does not protect the inside portion of the shoe and may affect the quality of the shoe over time. Additionally, the CROCS™ charms and other similar embellishments generally contain a circular-shaped base for insertion in a hole. Those charms are placed in a circular-shaped hole on the top surface of the shoe. Ultimately, consumers have to force the charm into the hole where the material around the hole must be stretched and absorb stress in all directions. The circular-shaped base is generally larger in size than the size of the hole in order to keep the charm secured in place. Consistently subjecting the hole to stress by forcefully inserting and removing the charm into the hole results in damage to the material around the hole. This damage may be in the form of overstretching or affecting the overall quality of the foam shoe over time. Other charms in the industry provide a snap and lock technique. However, those charms are provided in two pieces which snap apart and are not secured well enough in comparison to charms formed of a single, integral piece of material.

Accordingly, there is a need for an accessory that does not stress the hole of the foam shoe in all directions and further militates against dirt and debris from entering the foam shoe from the holes provided in the side surface of the shoe.

SUMMARY

In concordance with the instant disclosure, a shoe accessory that does not stress a hole of the foam shoe in all directions following installation and/or removal and further militates against dirt and debris from entering the foam shoe from the hole provided in the side surface, has surprisingly been discovered.

In one embodiment, a shoe accessory is configured to be removably attached to a polygonal hole of a shoe. The shoe accessory includes an outer flange having a first length, an inner flange having a second length greater than the first length, and a connecting portion spacing the outer flange from the inner flange where the connecting portion has a polygonal cross-section. The inner flange may be configured to be inserted through and disposed within the polygonal hole of the shoe. The outer flange may be configured to be disposed adjacent an outer surface of the shoe. Further, insertion of the inner flange into the polygonal hole may result in the polygonal hole being substantially stretched only along a single axis.

In another embodiment, a shoe accessory kit is provided. The shoe accessory kit includes a shoe with a polygonal hole and a shoe accessory configured to be removably attached to a polygonal hole of a shoe including an outer flange having a first length, an inner flange having a second length greater than the first length, and a connecting portion spacing the outer flange from the inner flange, the connecting portion having a polygonal cross-section. The perimeter of the polygonal cross-section of the connecting portion may be substantially the same as a perimeter of the polygonal hole of the shoe.

In a further embodiment, a method of inserting a shoe accessory into a shoe with a polygonal hole is provided. The method includes steps of providing a shoe with a polygonal hole and providing a shoe accessory configured to be removably attached to a polygonal hole of a shoe. Further inserting a part of the inner flange into the polygonal hole of the shoe and sliding the connecting portion to an edge of the polygonal hole of the shoe in order to push the outer flange to snap an opposite part of the inner flange into the polygonal hole of the shoe.

In certain embodiments, the shoe accessory can be configured as a shoe attachment as follows. A typical foam shoe, which are typically molded, includes expandable cut outs in the front and side faces. The shoe attachments may include a system for attaching decorative accessories to the outward faces of a shoe. The shoe attachment may include a trapezoidal body with a front facing shoulder which engages the outer face of the shoe. The front facing shoulder may be accessorized with a decorative embellishment. A second rear facing low profile shoulder may be inserted through the expandable cut out of the shoe to engage the inner surface of the front and side faces of the shoe, securing it in place. The shoe attachment for foam shoes may include a trapezoidal body, including a front facing shoulder, a second rear facing low profile shoulder, and a connecting portion. The shoe attachment may have a front face on the front facing shoulder. The front facing shoulder may have two back faces disposed adjacent to the connecting portion. The two back faces may have the same surface area. Similarly, the shoe attachment may have a back face on the second rear facing low profile shoulder. The second rear facing low profile shoulder may have two front faces. The surface area of the front face may be smaller than the surface area of the back face of the second rear facing low profile shoulder. The front facing shoulder may have a first length L1 formed by the top side of the front face L1 and a second length L2, formed by the bottom of the front face L2. The first length L1 may be shorter than the second length L2. The front facing shoulder may have rounded corners on the front face, which may form a trapezoidal shape. The second rear facing low profile shoulder may include a third length L3 formed by the top side of the back face and a fourth length L4, formed by the bottom of the back face. The third length L3 may be shorter than the fourth length L4. The second rear facing low profile shoulder may have rounded corners on the back face, which may form a trapezoidal shape. In some examples, the connecting portion may have a length L5 formed by the top side of the connecting portion and a length L6 formed by the bottom of the connecting portion. L6 may be longer than L5, and both L5 and L6 may be shorter than L3 or L4. The shoe attachments may have a width W1. The front facing shoulder may have a width W2. The connecting portion may have a width W3, and the second rear facing low profile shoulder may have a width W4. In certain examples, W3 may be larger than W2 or W4. In further examples, the sum of W2, W3, and W4 may be equivalent to W1. The shoe attachment may be formed out of suitable materials known to those of skill in the art. The shoe attachment may be formed out of plastics, polymers, metals, etc. In a more particular embodiment, the shoe attachment may be formed out of polyurethane, including flexible or rigid foam, binders, sealants, elastomers, and combinations thereof. In a most particular embodiment, the shoe attachment may be formed out of thermoplastic polyurethane (TPU). In a specific example, the shoe attachment may have a shore hardness of 85 A. The hardness may be measured by a durometer hardness on the ASTM D2240 standard Shore durometer scales. A shoe attachment with a shore hardness of 85 A may allow the shoe attachment to have a certain amount of resistance to bending. This may allow the shoe attachment to be flexible enough allow the second rear facing low profile shoulder to be wedged inside the expandable cut outs of the molded foam shoe. Examples having a shore hardness of 85 A may be able to flex with the molded foam shoe while militating against the displacement or removal of the shoe attachment. In more specific examples, the shoe attachment may be formed out of a TPU with a shore hardness of 85 A. Advantageously, the shoe attachments may be used to provide embellishments to existing products. Multiple shoe attachments may be used together in a system, allowing the user to interchange, remove, or rearrange the shoe attachments to customize the system. Further embodiments may contain insignias, ornamentation, symbols, and other forms of ornamentation that may be integral to the shoe attachment, permanently attached, or interchangeable.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
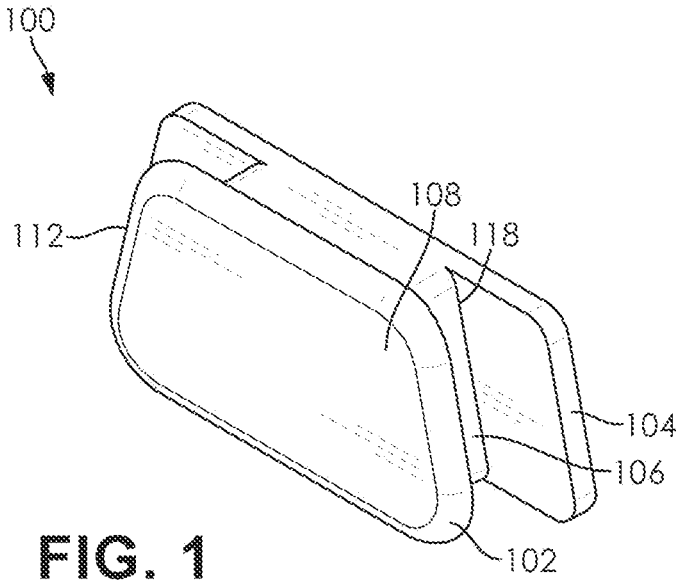
FIG. 1 is a top perspective view of a shoe accessory according to an embodiment of the present disclosure.
Figure 2:
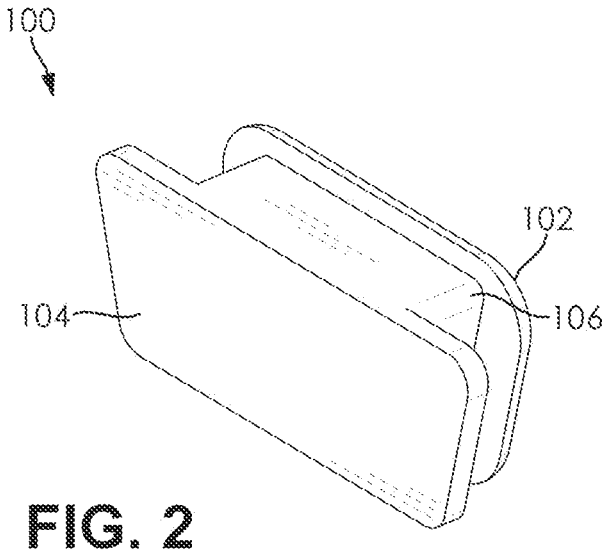
FIG. 2 is a bottom perspective view of the shoe accessory shown in FIG. 1.
Figure 3:
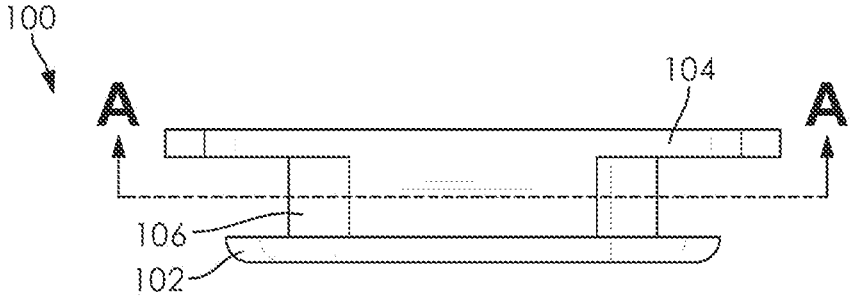
FIG. 3 is a top plan view of the shoe accessory shown in FIG. 1.
Figure 4:
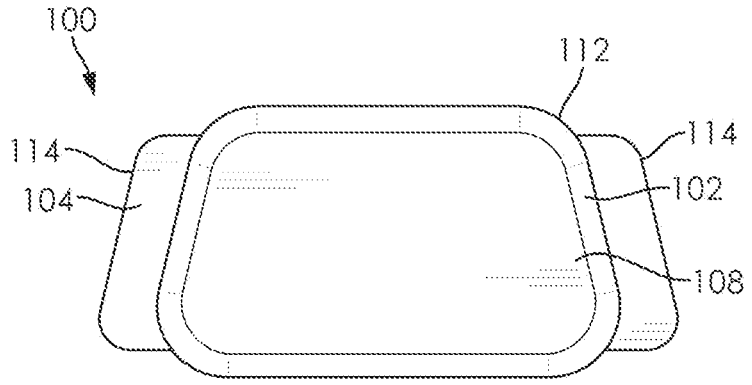
FIG. 4 is a front elevational view of the shoe accessory shown in FIG. 1.
Figure 5:
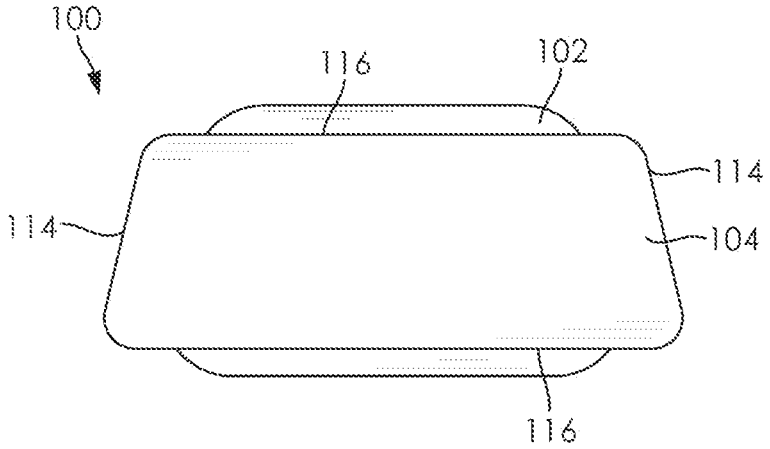
FIG. 5 is a rear elevational view of the shoe accessory shown in FIG. 1.
Figure 6:
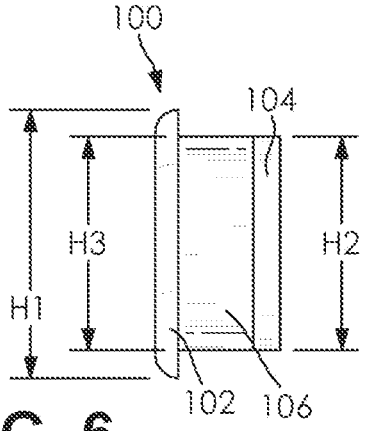
FIG. 6 is a right-side elevational view of the shoe accessory shown in FIG. 1.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps may be different in various embodiments, including where certain steps may be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

The present technology relates to a shoe accessory 100, a shoe accessory kit 200, and a method 300 of inserting the shoe accessory 100 into a shoe 202 with a polygonal hole 204, shown generally in FIGS. 1-12.

FIGS. 1-8 illustrate the shoe accessory 100, according to an embodiment of the present disclosure. The shoe accessory 100 may include an outer flange 102, an inner flange 104, and a connecting portion 106. The outer flange 102 may include a first length (L1) and the inner flange 104 may include a second length (L2) that may be greater than the first length (L1). The connecting portion 106 may space the outer flange 102 from the inner flange 104. The connecting portion 106 may further include a polygonal cross-section. The inner flange 104 may be configured to be inserted through the polygonal hole 204 of the shoe 202. The connecting portion 106 may be configured to be disposed within the polygonal hole 204 of the shoe 202. The outer flange 102 may be configured to be disposed adjacent an outer surface 110 of the shoe 202. Overall, insertion of the inner flange 104 into the polygonal hole 204 results in the polygonal hole 204 being substantially stretched only along a single axis (C).

The outer flange 102 may include the following aspects. The entire edge 112 of the outer flange 102 may extend beyond the polygonal cross-section of the connecting portion 106. The outer flange 102 may include a polygonal cross-section. As a non-limiting example, the outer flange 102 may include a trapezoidal cross-section. The outer flange 102 may also include a first height (H1).

The inner flange 104 may include the following aspects. The inner flange 104 may include a polygonal cross-section as well. As a non-limiting example, the inner flange 104 may include a trapezoidal cross-section. Two edges 114 of the inner flange 104 extend beyond the polygonal cross-section of the connecting portion 106 as well. The two edges 114 of the inner flange 104 may be interrupted by an edge 118 of the inner flange 104 that may be coextensive with the polygonal cross-section of the connecting portion 106. Further, the two edges 114 of the inner flange 104 that extend beyond the polygonal cross-section of the connecting portion 106 may be interrupted by two parallel edges 116 of the inner flange 104 that may be coextensive with the polygonal cross-section of the connecting portion 106. The inner flange 104 may also include a second height (H2).

The connecting portion 106 may include the following aspects. The polygonal cross-section of the connecting portion 106 may be a trapezoidal cross-section, as specifically shown in FIG. 8. The connecting portion 106 may also include a third length (L3) and the third length (L3) may be less than the first length (L1) of the outer flange 102 and may be less than the second length (L2) of the inner flange 104. The connecting portion 106 may include a third height (H3).

Figure 8:
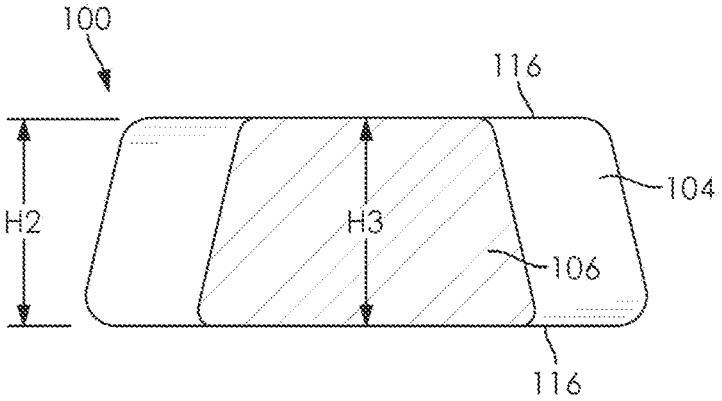
FIG. 8 is a cross-sectional view thereof taken along section line A-A in FIG. 3.
Figure 9:
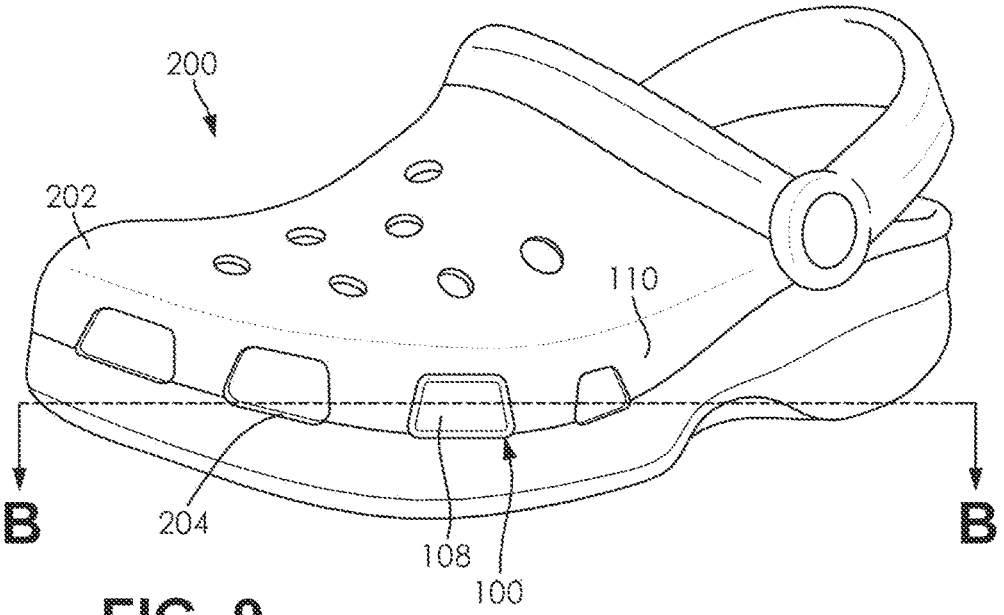
FIG. 9 is an environmental view of the shoe accessory in the hole of the foam shoe according to an embodiment of the present disclosure.

In some embodiments, the first height (H1) of the outer flange 102 may be greater than the second height (H2) of the inner flange 104 and may be greater than the third height (H3) of the connecting portion 106. In certain embodiments, the second height (H2) of the inner flange 104 may be substantially equal to the third height (H3) of the connecting portion 106, as shown in FIG. 8. As further indicated above, the edges 118 of the inner flange 104 interrupted by parallel edges 116 of the inner flange 104 may be coextensive with the polygonal cross section of the connecting portion 106 which further defines the substantial equal heights of the second height (H2) of the inner flange 104 and the third height (H3) of the connecting portion 106.

Figure 7:
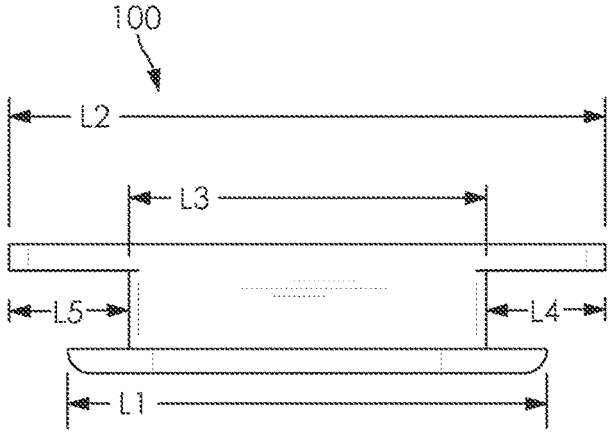
FIG. 7 is a bottom plan view of the shoe accessory shown in FIG. 1.
Figure 11:
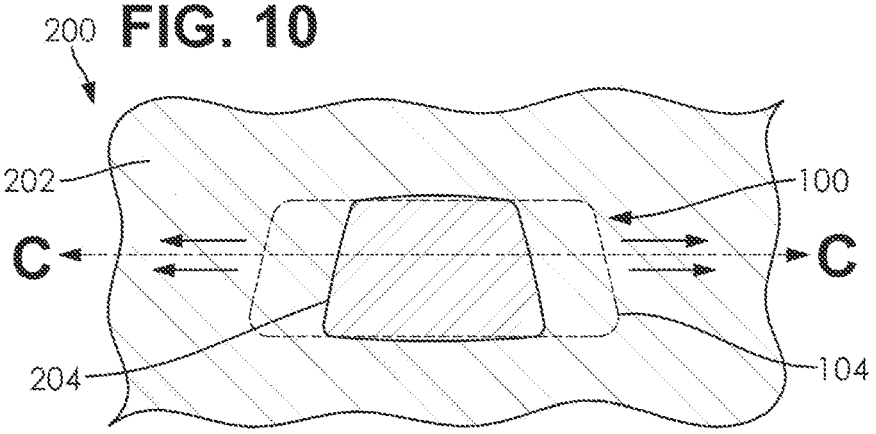
FIG. 11 is an environmental view of the shoe accessory when inserted into the polygonal hole, further depicting a tension placed upon the polygonal hole by the shoe accessory along axis (C)
Figure 12:
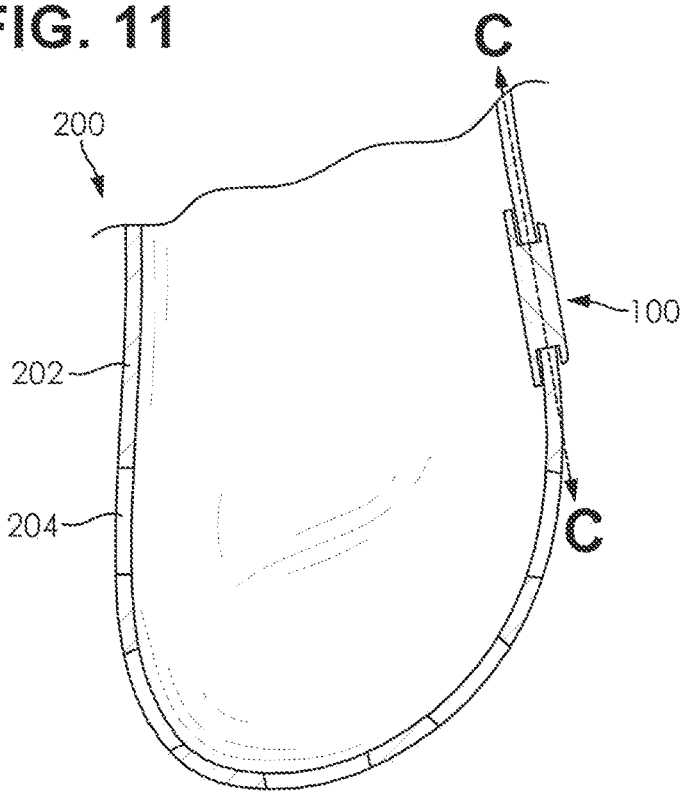
FIG. 12 is a cross-sectional view thereof taken along plane B-B as depicted in FIG. 9.

Advantageously, the connecting portion 106 and the inner flange 104 may have similar heights (e.g., where H3=H2) in order to limit the amount of stretch subjected to the material of the shoe 202 forming the polygonal hole 204 in all directions. An additional fourth length (L4) and a fifth length (L5) may be provided, as shown in FIG. 7. In an exemplary embodiment, the fourth length (L4) may be greater than the fifth length (L5). In another exemplary embodiment, the fourth length (L4) may be less than the fifth length (L5). In another embodiment, the fourth length (L4) may be equal to the fifth length (L5). More specifically, the installation process of the shoe accessory 100 provides inserting part of the inner flange 104 through the polygonal hole, as further described in the method 300 hereinbelow, such that the polygonal hole 204 is only substantially stretched according to the fourth length (L4) or according to the fifth length (L5), along a single axis (C) rather than in all directions, as shown in FIG. 11. Advantageously, this allows the polygonal hole 204 to better maintain its integrity and overall lifespan by reducing the risk of overstretching the material of the shoe 202 forming the polygonal hole 204.

As a non-limiting example, the shoe accessory 100 may be manufactured as a unitary piece of material. One of ordinary skill in the art may manufacture the shoe accessory 100 as a single piece or multiple pieces within the scope of the present disclosure. The shoe accessory 100 may also be manufactured out of suitable materials such as plastic, polymers, metals, and more. As a non-limiting example, the plastic material may be polyurethane further including flexible or rigid foam, binders, sealants, elastomers, and combinations thereof. In another non-limiting example, the shoe accessory 100 may be formed out of thermoplastic polyurethane (TPU) and have a shore hardness of 85 A. The hardness may be measured by a durometer hardness on the ASTM D2240 standard shore durometer scale (available at astm.org). One of ordinary skill in the art may select suitable material and shore hardness values to manufacture the shoe accessory 100 within the scope of the present disclosure. Advantageously, the shoe accessory 100 is flexible enough to allow the inner flange 104 to be popped through the polygonal hole 204 of the shoe 202 during the installation process and further militates against the displacement or removal of the shoe accessory 100 when in place.

Figure 10:
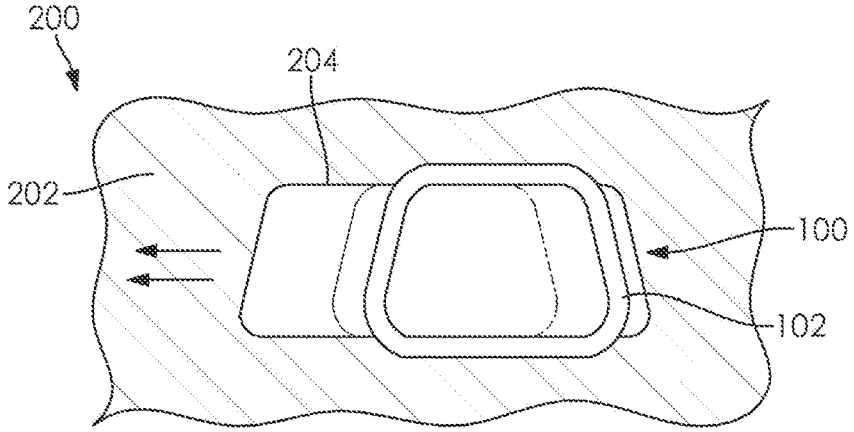
FIG. 10 is an environmental view of the shoe accessory being inserted into the polygonal hole of the shoe.

According to another embodiment of the present disclosure, a shoe accessory kit 200 is provided, as shown in FIGS. 9-12. The shoe accessory kit 200 may include a shoe 202 with a polygonal hole 204 and a shoe accessory 100 configured to be removably attached to the polygonal hole 204 of the shoe 202 as described hereinabove. As a non-limiting example, the shoe 202 may be a foam shoe. One of ordinary skill in the art may select a suitable shoe 202 within the scope of the present disclosure. A perimeter of the polygonal cross-section of the connecting portion 106 may be substantially the same as a perimeter of the polygonal hole 204 of the shoe 202. The shoe accessory 100 may be disposed in the polygonal hole 204 of the shoe 202 and the connecting portion 106 may seal an entirety of the polygonal hole 204. Advantageously, the connecting portion 106 may provide a friction fit into the polygonal hole 204 which provides an effective seal of the opening of the polygonal hole 204 of the shoe to militate against dirt or debris from entering the shoe 202 when in use. With further reference to FIGS. 10 and 11, when the shoe accessory 100 is disposed in the polygonal hole 204, the shoe accessory 100 exerts tension and substantially stretches the polygonal hole 204 only along the single axis (C), which is illustrated by the arrows in FIG. 11. There may be minimal tension around the remaining area of the polygonal hole 204, however the polygonal hole 204 is substantially stretched only along the single axis (C). Ultimately, this militates against the polygonal hole 204 from being stretched in all directions and therefore supports the integrity of the structure and shape of the polygonal hole 204.

Additionally, the outer flange 102 may include a face 108. The face 108 may include one or more of an indicium, a graphic, and a color different from the shoe 202. The face 108 may alternatively include a color similar to the shoe 202. Users may further customize the shoe 202 by selecting a feature to place on the face 108 of the shoe accessory 100. The feature may be disposed on the face 108 of the shoe accessory 100 with an adhesive, for example. One skilled in the art may select suitable adhesives within the scope of the present disclosure. Alternatively, the feature may be coupled to the outer flange 102 to completely or partially cover the face 108 of the shoe accessory 100. The feature may be coupled thereto in various ways, including a snap fit, adhesive, or other fastening means. The feature may include an indicium, a graphic, and/or a color that complements or contrasts with the shoe 202.

Figure 13:
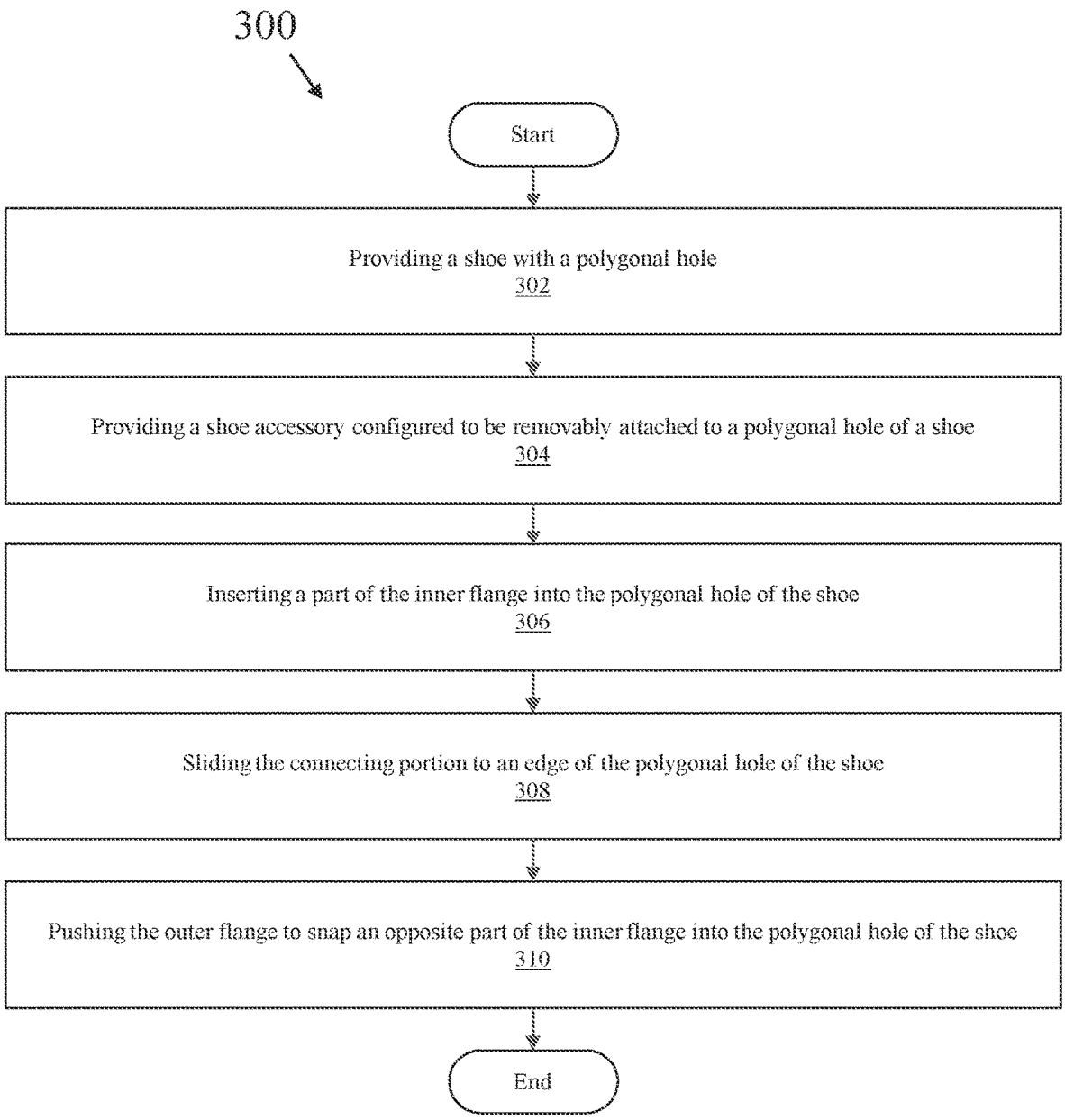
FIG. 13 is a flowchart illustrating a method of inserting the shoe accessory into a shoe with a polygonal hole according to an embodiment of the present disclosure.

FIG. 13 is a flowchart that describes a method 300 of inserting a shoe accessory 100 into a polygonal hole 204 of a shoe 202, according to an embodiment of the present disclosure. At 302, the method may include providing a shoe 202 with a polygonal hole 204. At 304, the method may include providing a shoe accessory 100 configured to be removably attached to a polygonal hole 204 of a shoe 202 as described hereinabove. At 306, the method may include inserting a part of the inner flange 104 into the polygonal hole 204 of the shoe 202, as also illustrated in FIG. 10. More specifically, a part of the inner flange 104 may be inserted into the polygonal hole 204 at a slight angle. At 308, the method may include sliding the connecting portion 106 to an edge of the polygonal hole 204 of the shoe 202. At 310, the method may include pushing the outer flange 102 to snap an opposite part of the inner flange 104 into the polygonal hole 204 of the shoe 202 whereby the inner flange 104 may be disposed adjacent an inner surface of the shoe 202 resulting in the polygonal hole 204 being substantially stretched only along the single axis (C), as also illustrated in FIG. 11. Advantageously, the opposite side of the inner flange pops into place when pressure is applied to the outer flange 102 which only substantially stretches the polygonal hole 204 along the single axis (C) and not all directions surrounding the polygonal hole 204.

Advantageously, the shoe accessory 100 may include a connecting portion 106 that may be configured to provide a friction fit into the polygonal hole 204 which provides an effective seal of the opening of the polygonal hole 204 of the shoe to militate against dirt or debris from entering the shoe 202 when in use. Additionally, the lengths and heights of the inner flange 104 and the connecting portion 106 allow for a unique installation process. More specifically, the installation process of the shoe accessory 100 by inserting part of the inner flange 104 through the polygonal hole results in the polygonal hole 204 being substantially stretched in the single axis (C) rather than in all directions. Desirably, this allows the polygonal hole 204 to maintain its integrity and overall quality by reducing the risk of overstretching the polygonal hole 204.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods may be made within the scope of the present technology, with substantially similar results.

What is claimed is:

1. A shoe accessory configured to be removably attached to a polygonal hole of a shoe, the shoe accessory comprising:

an outer flange having a first length;

an inner flange having a second length greater than the first length; and a connecting portion spacing the outer flange from the inner flange, the connecting portion having a polygonal cross-section;

wherein:

the inner flange is configured to be inserted through the polygonal hole of the shoe, the connecting portion is configured to be disposed within the polygonal hole of the shoe, the outer flange is configured to be disposed adjacent an outer surface of the shoe, insertion of the inner flange into the polygonal hole results in the polygonal hole being stretched along an axis; and two edges of the inner flange extend beyond the polygonal cross-section of the connecting portion and are interrupted by an edge of the inner flange that is coextensive with the polygonal cross-section of the connecting portion.

2. The shoe accessory of claim 1, wherein the polygonal cross-section of the connecting portion is a trapezoidal cross-section.

3. The shoe accessory of claim 1, wherein an entire edge of the outer flange extends beyond the polygonal cross-section of the connecting portion.

4. The shoe accessory of claim 1 wherein the polygonal cross-section of the connecting portion is trapezoidal and the two edges of the inner flange that extend beyond the polygonal cross-section of the connecting portion are interrupted by two parallel edges of the inner flange that are coextensive with the polygonal cross-section of the connecting portion.

5. The shoe accessory of claim 1, wherein the outer flange has a first height, the inner flange has a second height, and the connecting portion has a third height.

6. The shoe accessory of claim 5, wherein the first height is greater than the second height and the third height.

7. The shoe accessory of claim 5, wherein the second height is substantially equal to the third height.

8. The shoe accessory of claim 1, wherein the connecting portion further includes a third length, the third length is less than the first length and the second length.

9. A shoe accessory kit comprising:

a shoe with a polygonal hole; and the shoe accessory of claim 1.

10. The shoe accessory kit of claim 9, wherein a perimeter of the polygonal cross-section of the connecting portion is substantially the same as a perimeter of the polygonal hole of the shoe.

11. The shoe accessory kit of claim 9, wherein the connecting portion is disposed in the polygonal hole of the shoe.

12. The shoe accessory kit of claim 11, wherein the connecting portion seals an entirety of the polygonal hole.

13. The shoe accessory kit of claim 12, wherein the connecting portion provides a friction fit into the polygonal hole.

14. The shoe accessory kit of claim 9, wherein the outer flange includes a face including a color different from the shoe.

15. A method of shoe decoration, the method including steps of:

providing a shoe with a polygonal hole;

providing the shoe accessory of claim 1;

inserting a part of the inner flange into the polygonal hole of the shoe;

sliding the connecting portion to an edge of the polygonal hole of the shoe; and pushing the outer flange to fit an opposite part of the inner flange through the polygonal hole of the shoe, whereby the inner flange is disposed adjacent an inner surface of the shoe resulting in the polygonal hole being stretched along the axis.

16. A shoe accessory configured to be removably attached to a polygonal hole of a shoe, the shoe accessory comprising:

an outer flange having a first length;

an inner flange having a second length greater than the first length; and a connecting portion spacing the outer flange from the inner flange, the connecting portion having a polygonal cross-section;

wherein:

the inner flange is configured to be inserted through the polygonal hole of the shoe, the connecting portion is configured to be disposed within the polygonal hole of the shoe, the outer flange is configured to be disposed adjacent an outer surface of the shoe, and insertion of the inner flange into the polygonal hole results in the polygonal hole being stretched along an axis, wherein the polygonal cross-section of the connecting portion is a trapezoidal cross-section, wherein an entire edge of the outer flange extends beyond the polygonal cross-section of the connecting portion, wherein two edges of the inner flange extend beyond the polygonal cross-section of the connecting portion, wherein the two edges of the inner flange are interrupted by an edge of the inner flange that is coextensive with the polygonal cross-section of the connecting portion, wherein the polygonal cross-section of the connecting portion is trapezoidal and the two edges of the inner flange that extend beyond the polygonal cross-section of the connecting portion are interrupted by two parallel edges of the inner flange that are coextensive with the polygonal cross-section of the connecting portion, wherein the outer flange has a first height, the inner flange has a second height, and the connecting portion has a third height, wherein the first height is greater than the second height and the third height, wherein the second height is substantially equal to the third height, wherein the connecting portion further includes a third length, the third length is less than the first length and the second length.

17. A shoe accessory configured to be removably attached to a polygonal hole of a shoe, the shoe accessory comprising:

an outer flange having a first length;

an inner flange having a second length greater than the first length; and a connecting portion spacing the outer flange from the inner flange, the connecting portion having a polygonal cross-section;

wherein:

the inner flange is configured to be inserted through the polygonal hole of the shoe, the connecting portion is configured to be disposed within the polygonal hole of the shoe, the outer flange is configured to be disposed adjacent an outer surface of the shoe, insertion of the inner flange into the polygonal hole results in the polygonal hole being stretched along an axis;

two edges of the inner flange extend beyond the polygonal cross-section of the connecting portion; and the polygonal cross-section of the connecting portion is trapezoidal and the two edges of the inner flange that extend beyond the polygonal cross-section of the connecting portion are interrupted by two parallel edges of the inner flange that are coextensive with the polygonal cross-section of the connecting portion.

* * * * *